United States Patent [19]

Pearson

[11] 4,011,608

[45] Mar. 15, 1977

[54] ELECTRIC TOILET DEODORIZER

[76] Inventor: Raymond H. Pearson, 627 Sherwood Drive, Richardson, Tex. 75080

[22] Filed: Dec. 22, 1975

[21] Appl. No.: 643,596

Related U.S. Application Data

[63] Continuation-in-part of Ser. No. 434,519, Jan. 18, 1974, Pat. No. 3,927,429.

[52] U.S. Cl. ..... 4/213

[51] Int. Cl.[2] ..... E03D 9/04; A47K 13/00

[58] Field of Search ..... 4/213, 217, 209, 211, 4/DIG. 3

[56] References Cited

UNITED STATES PATENTS

| | | | |
|---|---|---|---|
| 2,575,778 | 11/1951 | Wilson | 4/213 |
| 3,102,275 | 9/1963 | Raymond | 4/213 |
| 3,366,979 | 2/1968 | Johnston | 4/213 |
| 3,495,282 | 2/1970 | Taggart | 4/213 |
| 3,626,554 | 12/1971 | Martz | 4/213 |
| 3,691,568 | 9/1972 | Martz | 4/213 |

*Primary Examiner*—Henry K. Artis

[57] ABSTRACT

An electric deodorizer for water closets is disclosed which includes an air duct entering the water tank so as to draw odorous air from the toilet bowl via the water tank overflow duct, an air blower to establish the odorous air flow, and a control means which is responsive to the change in operating characteristics of the air blower when the toilet is flushed, so as to automatically terminate the deodorization.

6 Claims, 4 Drawing Figures

ELECTRIC TOILET DEODORIZER

CROSS REFERENCE TO RELATED APPLICATION

This is a continuation-in-part of my pending application Ser. No. 434,519, filed Jan. 18, 1974, now U.S. Pat. No. 3,927,429.

BACKGROUND OF THE INVENTION

1. Field of the Invention

This invention relates to electric toilet deodorizers of the type which draw odorous air from the toilet bowl, through the water tank overflow duct, and through an air duct, by means of an air blower. The blower may discharge into the atmosphere outside the dwelling, or may discharge through an odor filter into the dwelling. More particularly, the invention relates to the above type of deodorizers which include an electrical control to terminate the ventilation when the toilet is flushed.

2. Description of the Prior Art

In addition to applicants aforementioned pending application, others have disclosed toilet deodorizers which include automatic controls for terminating ventilation when the toilet is flushed. The following patents are illustrative:

U.S. Pat. No. 1,342,716

U.S. Pat. No. 2,881,450

U.S. Pat. No. 1,342,716 teaches a normally open switch which is automatically closed when the toilet seat is occupied, initiating the deodorizer. A special linkage engages the water valve float within the water tank when the water level falls below a predetermined level after flushing the toilet. This causes the switch to open, terminating the deodorization.

U.S. Pat. No. 2,881,450 teaches a switch which is operated by an auxiliary float which senses the water level in the water tank. When the toilet is flushed, the water level falls, and the switch is operated at a predetermined water level, terminating the deodorization.

ADVANTAGES OVER THE PRIOR ART

A problem develops when the method of a float operated switch is employed in the type of deodorizer described above. With the float operated switch, there is necessarily a time delay between the flushing of the toilet and the termination of deodorization, because the water level must fall before the switch can change states. The air suction remains applied during this interval, and retards the normal rapid flushing cycle of the toilet, inasmuch as the suction subtracts from the water head in the water tank. The present invention eliminates the time lag and the resulting problem, by utilizing a sensing means which detects the change in operating characteristics of the air blower at the moment the toilet is flushed, whereby deodorization is terminated at this same moment. The change in operating characteristics results from water flooding the overflow duct, blocking the air flow through it. This method is also more reliable, and does not require that switches, or other electrical transducers, be mounted within the water tank.

SUMMARY OF THE INVENTION

It is an object of this invention to provide an improved deodorizer for toilets.

It is another object of this invention to provide a toilet deodorizer which is more reliable and simpler to install than previous similar types.

It is still another object of this invention to provide immediate automatic termination of the deodorization when the toilet is flushed, and in a manner which insures that the normal rapid flushing cycle of the toilet will not be retarded.

It is yet another object of this invention to provide for the immediate automatic termination of the toilet deodorization by a means which is responsive to the change in operating characteristics of the air blower at the moment the toilet is flushed.

BRIEF DESCRIPTION OF THE DRAWINGS

With the foregoing objects and features in view, and such other objects and features which may become apparent as this specification proceeds, the invention will be understood from the following description, taken in conjunction with the accompanying drawings, in which like characters of reference are used to designate like parts, and in which.

DESCRIPTION OF THE PREFERRED EMBODIMENTS

Figure 1:
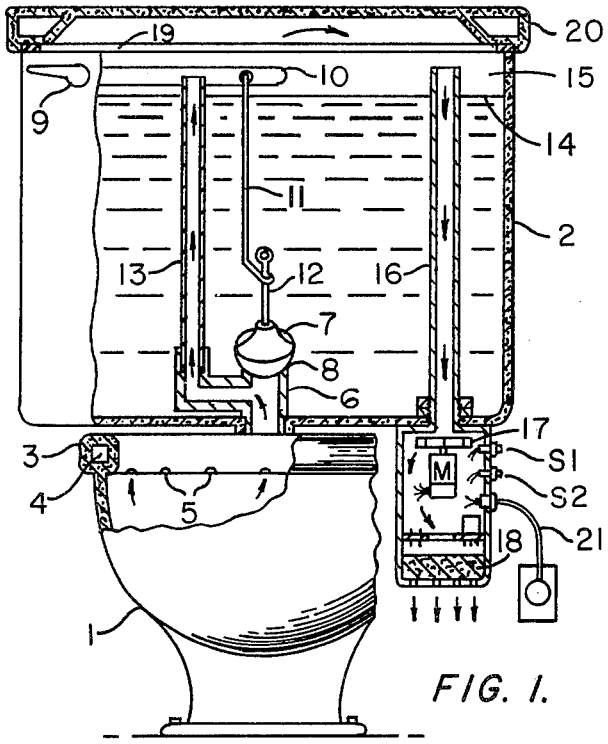
FIG. 1 is a front elevation view, shown partially in section, of a toilet equipped with the preferred deodorizer, showing typical toilet detail together with detail of the deodorizer. A portion of the toilet bowl has been broken away to reveal the deodorizer mounted adjacent to the rear of the bowl, the bowl being substantially narrower at the rear.

Referring to the drawings in detail, and particularly FIG. 1, there is illustrated a toilet deodorizer which is adapted to a conventional water closet including a toilet bowl 1 and water tank 2. The top of the toilet bowl 1 includes a hollow rim 3 which defines a flush-water distribution channel 4, having water distribution holes 5 around the bottom edge. The water tank 2 is usually seated on the rear of the toilet bowl 1, or integral therewith, and is connected by means of a water discharge conduit 6 to a mating aperture (not shown) in the hollow rim 3. Some of the customary internal water tank hardware is shown including a tank ball valve 7, which is shown in the normally closed position seated on the tank ball valve seat 8 at the upper terminus of the water discharge conduit 6. The tank ball 7 is adapted in the conventional manner to be lifted upon manual operation of the flushing mechanism including a flushing handle 9, lever 10, linkage 11, and rod 12, whereupon water flows from the water tank 2, through the water discharge conduit 6, into the water distribution channel 4, and out through the water distribution holes 5, so as to flush the toilet bowl 1. Other types of flushing valves, in lieu of the tank ball 7, are suitable also. An overflow duct 13 is connected into the water discharge conduit 6, or integral therewith, at a point beneath the tank ball 7. It will be understood that the water tank 2 also includes the usual water inlet pipe and automatic tank filling valve or ballcock (not shown), so as to refill the water tank 2 to a predetermined water level 14 after each flushing cycle. The water level 14 is in all cases below the upper terminus of the overflow duct 13. An air space 15 is always provided above the water line 14.

The preferred embodiment of the toilet ventilator includes an air duct 16, passing through a hole in the bottom of the water tank 2, in communication with the air space 15, a centrifugal blower 17, a motor M, and an activated charcoal odor filter 18. When the deodorizer is initiated, odorous air is drawn in seriatim from the toilet bowl 1, through the water distribution holes 5, through the water distribution channel 4, through the water discharge conduit 6, through the overflow duct 13, through the air duct 16, into the centrifugal blower 17, and is discharged through the odor filter 18, which freshens the air. The air flow is represented by arrows. A seal 19 is provided between the upper rim of the water tank 2 and the cover 20, so as to effect a more efficient flow of air through the toilet bowl 1. Electrical switches, S1 and S2, are included to respectively initiate and manually terminate the deodorizer. An electrical cord 21 supplies power to the deodorizer. The usual water seals, washers, and nuts are provided at the base of the air duct 16.

It will be understood that the preferred embodiment reduces the air pressure of the water tank air space 15, causing the aforementioned odorous air flow. The pressure of the air space 15 is commonly reduced by one to two inches of water below atmospheric pressure when the ventilator is in use. When the toilet is flushed, water immediately floods the overflow duct 13, effectively blocking the flow of air through it. At this time the pressure of the air space 15 falls to nearly that of the intake side of the centrifugal blower 17, which is commonly up to four inches of water below atmospheric pressure, depending upon the size of the blower and air duct employed. It will be appreciated that the water head in the water tank is only about eight to ten inches, and the sudden decrease in air pressure subtracts appreciably from this water head, retarding the gravity flow of water from the tank 2 into the bowl 1. As a remidy, I have invented the current deodorizer system which automatically terminates the air suction at the moment the toilet is flushed, allowing a normal rapid flushing cycle.

The present invention makes use of the fact that when the toilet is flushed, and water floods the overflow duct 13, effectively blocking the flow of air through it, the operating characteristics of the air blower 17 are appreciably changed. Assuming a backwardly curved centrifugal blade 17, the intake and discharge air flow rates and pressures decrease. Assuming a small permanent magnet direct current motor M, the rotative speed increases, the motor current decreases, the motor voltage increases, the motor torque decreases, and the axial thrust on the armature shaft increases. Any of these changes in operating characteristics may be sensed by electrical, electronic, or mechanical means, which may be employed to terminate the deodorizer at the moment the toilet is flushed. The actual change in operating characteristics depends somewhat upon the type of blower blade and motor employed, but all types will manifest operating characteristic changes which may be sensed by suitable circuitry designed by those skilled in the art.

Figure 2:
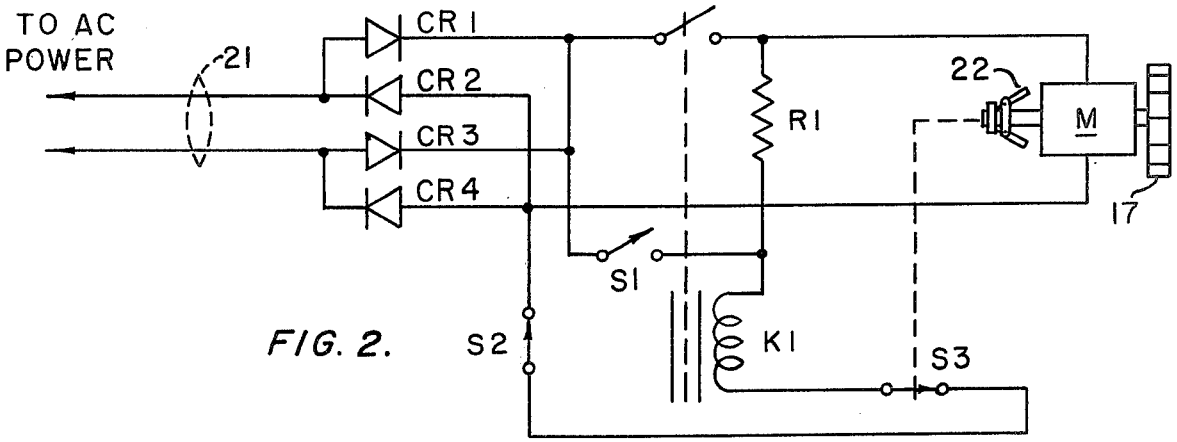
FIG. 2 is partially a schematic diagram and partially a diagramatic view showing an electrical circuit which is suitable for this invention when the sensing means is a motor driven centrifugal switch.

In the preferred embodiment, I have selected the increase in rotative speed of the centrifugal blower 17 as the most practical example of a change in operating characteristics. Referring to FIG. 2, the deodorizer is started by momentarily closing the switch S1, which is ideally a momentary-contact push button switch. This latches the relay K1 closed through the resistor R1, starting the motor M. Switch S2, a normally closed momentary-contact push button switch, is provided to manually terminate the deodorization if so desired. The switch S2 unlatches the relay K1, removing power from the motor M. Centrifugal weights 22, suitably mounted on the motor shaft, together with a stationary normally closed switch S3, have been included to sense the increase in rotative speed of the motor M when the toilet is flushed. This type of centrifugal switch is universally employed in split phase and capacitor-start AC motors to switch out the starting windings after the motor starts, and is very familiar to those skilled in the art. When the deodorizer is initiated, the bias springs (not shown) hold the weights 22 in the rest position, and the switch S3 remains closed. When the toilet is flushed however, the motor speeds up substantially, causing the weights 22 to overcome the bias springs (not shown), opening the switch S3, unlatching the relay K1, which removes power from the blower motor M. This removes the air suction from the water tank air space 15, promoting a normal rapid flushing cycle. Rectifiers CR1, CR2, CR3, and CR4 allow the use of an AC power source, together with a small permanent magnet direct current motor M. The rectifiers may be omitted if a universal motor M is employed.

Figure 3:
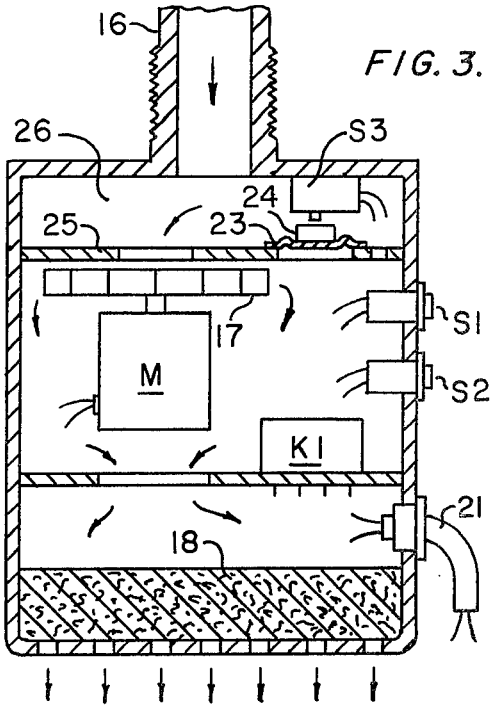
FIG. 3 is an enlarged sectional view of an alternate embodiment including pressure sensing means.
Figure 4:
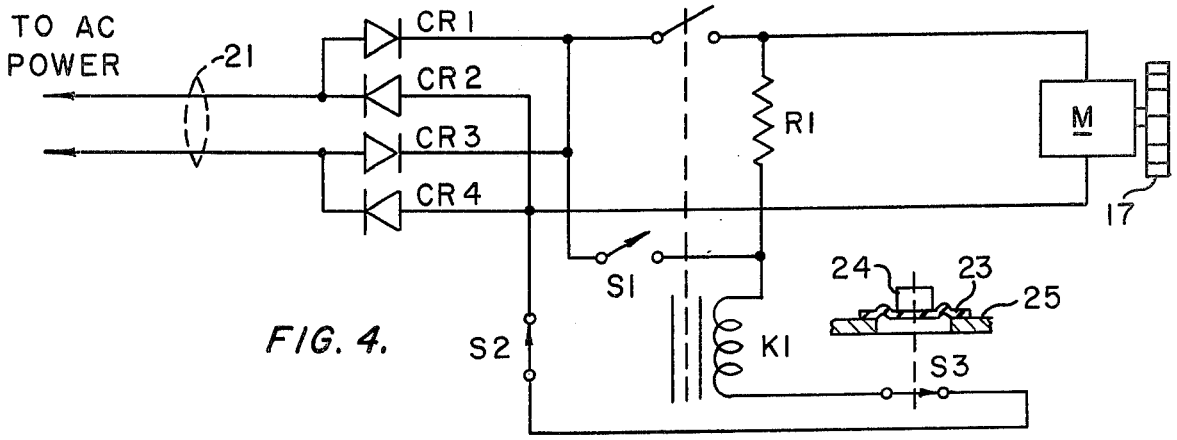
FIG. 4 is partially a schematic diagram and partially a diagramatic view showing an electrical circuit which is suitable for this invention when the sensing means is responsive to the intake pressure of the air blower.

Considering now the method taught first in the aforementioned pending application, FIG. 3 portrays a flexible rubber diaphragm 23 and weight 24 attached to a bulkhead 25, and suitably linked to the switch S3. FIG. 4 shows an electrical circuit suitable for use with this method. When the ventilator is started, the suction in the cavity 26 is not sufficient to overcome the weight 24, and the switch S3 remains closed. When the toilet is flushed, the intake pressure of the backwardly-curved centrifugal blower 17 decreases, overcoming the weight 24 which moves upward causing the switch S3 to open, terminating the deodorization as before. Other types of pressure sensors are taught in the art, and may be easily employed. Any sensors which are responsive to the rate of air flow are equally suitable. The sensor need only sense a change in the air blower intake or discharge pressure or flow rate when the toilet is flushed, and need not measure the exact pressure or rate unless so desired. Inasmuch as the change is easily sensed from any point in the accessary, the sensor may be located most anywhere within the accessary. Control circuits which are compatible with the sensor selected are easily designed by those skilled in the art.

It will be observed by those skilled in the art, that various other electrical, electronic and mechanical sensing means may be employed to respond to any of the changes in operating characteristics of the air blower 17 and motor M when the toilet is flushed. The invention is also useful for use with toilet ventilators of the type described in the art wherein the air duct 16 runs to an air blower located remotely, such as in the attic or under the floor, and which discharges into the atmosphere outside of the dwelling. It is also suitable for use with ventilators, taught in the art, in which the air duct 16 connects directly into the overflow duct 13, eliminating the need for the seal 19. In the latter case, the invention serves as an automatic cut-off, and is not necessary to prevent flushing retardation.

In addition to terminating power to the motor M, it is usually desirable that the air and electrical control means employed be capable of stopping the suction very rapidly. Applicant has disclosed the use of brakes and valves for accomplishing this in his pending applications Ser. Nos. 496,954, and 540,538.

While the preferred embodiments are especially well suited for use as a toilet deodorizer, it is recognized that the invention is readily adaptable for use with most other electrically controlled deodorizers which ventilate through the overflow duct 13. The invention as disclosed may be modified without departing from the principles and scope of the invention, and it is not desired to limit the invention to the exact construction shown and described herein.

What is claimed is:

1. A water closet deodorizing accessary, said water closet including a toilet bowl and water tank, said water tank including a flushing means and overflow duct, said accessary comprising air duct means communicative with said overflow duct, an air blower means having an intake side and a discharge side, said intake side communicative with to said air duct means, and control means operable to initiate air flow through said air duct means, whereby odorous air may be drawn from said toilet bowl, through said overflow duct, said control means also operable to terminate said air flow, said control means including sensing means responsive to the change in operating characteristics of said air blower means when said overflow duct is flooded with water so as to impede said air flow when said toilet bowl is flushed, said sensing means having at least one parameter responsive to said change in operating characteristics, whereby said air flow may be terminated in response to said change in operating characteristics when said toilet bowl is flushed.

2. The accessary according to claim 1, said sensing means capable of sensing a change in the rotative speed of said air blower means when said toilet is flushed.

3. The accessary according to claim 1, said sensing means capable of sensing a change in the intake or discharge air pressure or air flow rate of said air blower means when said toilet is flushed.

4. The accessary according to claim 1, said sensing means capable of sensing a change in the power requirements of said air blower means when said toilet is flushed.

5. The accessary according to claim 1, said sensing means capable of sensing a change in the axial thrust of said air blower means when said toilet is flushed.

6. The accessary according to claim 1, said sensing means capable of sensing a change in the torque of said air blower means when said toilet is flushed.

* * * * *

UNITED STATES PATENT OFFICE

CERTIFICATE OF CORRECTION

Patent No. 4,011,608 Dated March 5, 1977

Inventor(s) Raymond H. Pearson

It is certified that error appears in the above-identified patent and that said Letters Patent are hereby corrected as shown below:

Column 5, line 23, delete "to".

Signed and Sealed this

*Twenty-seventh* Day of *December 1977*

[SEAL]

*Attest:*

RUTH C. MASON
*Attesting Officer*

LUTRELLE F. PARKER
*Acting Commissioner of Patents and Trademarks*